United States Patent [19]

Rones

[11] Patent Number: 4,724,567

[45] Date of Patent: Feb. 16, 1988

[54] POLISHING AND SCRUBBING PAD

[75] Inventor: James M. Rones, Atlanta, Ga.

[73] Assignee: Americo Manufacturing Company, Inc., Acworth, Ga.

[21] Appl. No.: 883,667

[22] Filed: Jul. 9, 1986

[51] Int. Cl.[4] ..... B24B 29/00; A47L 11/14

[52] U.S. Cl. ..... 15/98; 15/230.14; 15/230.16; 15/230.17

[58] Field of Search ..... 15/98, 230.14, 230.16, 15/230.17, 230.19, 230; 51/170 T, 177, 397, 209 R

[56] References Cited

U.S. PATENT DOCUMENTS 3,243,833 4/1966 Hencken ..... 15/230.16

4,502,174 3/1985 Rones ..... 15/98

*Primary Examiner*—Edward L. Roberts

*Attorney, Agent, or Firm*—Sughrue, Mion, Zinn, Macpeak, and Seas

[57] ABSTRACT

A polishing and scrubbing pad for a floor polishing machine is provided and which comprises a plurality of equally dimensioned segments secured together by a connector in such a manner that spaces exist between the segments, each of which has a leading cutting edge for cutting old wax from a floor being worked on.

9 Claims, 3 Drawing Figures

FIG. 1
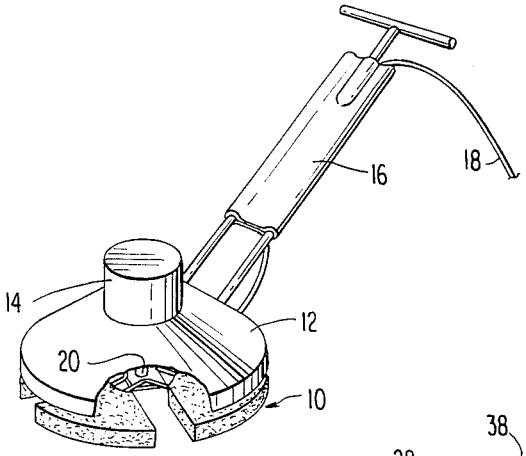
FIG. 2
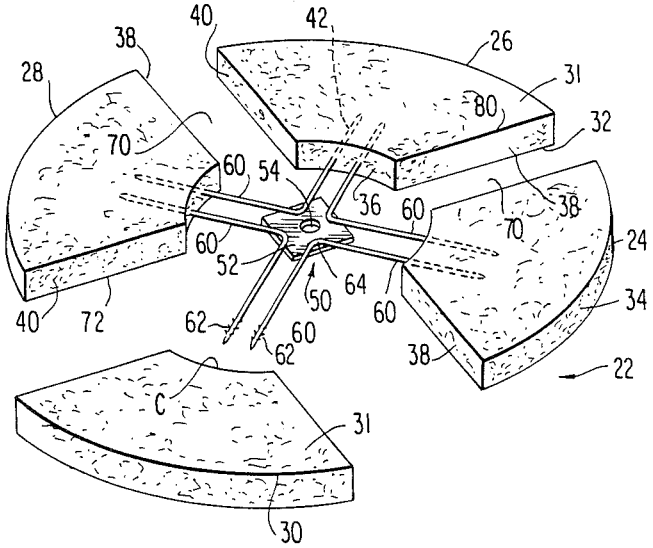
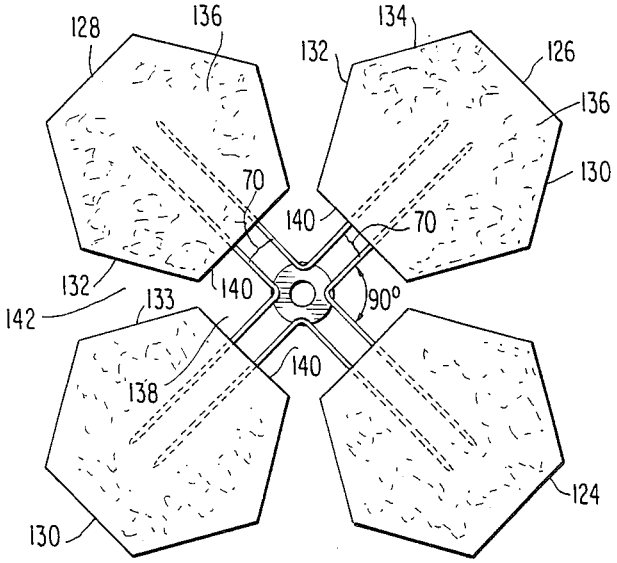
FIG. 3

POLISHING AND SCRUBBING PAD

BACKGROUND OF THE INVENTION

1. Field of the Invention

This invention relates to a polishing and scrubbing apparatus similar to polishing pads used with electric or propane fueled internal combustion engine polishing machines.

2. Statement of the Prior Art

The prior art shows numerous structures of polishing pads for use with floor polishing machines. These pads conventionally have a central aperture for attaching them to the undersurface of a polishing machine. One of the disadvantages of these conventional pads is that they do not present cutting surfaces to cut wax from the floor. An additional disadvantage of conventional pads is that they create a great amount of drag on the machine often resulting in overheating and consequent overloading of electrical circuits.

The present invention overcomes the disadvantages in conventional pads by providing a polishing apparatus having multiple cutting edges to remove hardened wax on a floor as well as reduced surface area thus preventing drag.

Representative of prior art devices are disclosed in the following U.S. Pat. Nos. and copies are furnished for the record: 3,183,542 on 5/1965 to Anders; 3,793,665 on 2/1974 to Thielen; 4,307,480 on 12/1891 to Fallen; 4,502,174 on 5/1985 to Rones.

SUMMARY OF THE INVENTION

There is a need for a floor polishing and scrubbing pad for use with floor polishing machines which presents multiple edges to aid in removal of hardened wax.

It is therefore one object of this invention to provide a polishing and scrubbing pad for use with floor polishing machines which has a reduced surface area whereby less drag is created on the machine during use thus reducing overheating of the machine.

It is another object of this invention to provide a polishing and scrubbing pad for use with floor polishing machines having reduced floor engaging areas yet having multiple cutting edges for effecting removal of hardened wax on a floor.

And another object of the invention is to provide a polishing and scrubbing pad for use with floor polishing machines having a plurality of polishing and scrubbing members connected together in spaced apart relationship by a single piece of connector hardware.

It is still another object of this invention to provide barbed ends on the connector hardware for simplicity in attaching the polishing and scrubbing members together in a correct position with respect to each other.

This invention overcomes the disadvantage of conventional pads in that less material is in contact with the floor thus reducing drag on the machine which, in the case of spray buffing, will prevent the machine from becoming overloaded and breaking electrical circuits. This is important because in conventional machines when they go down it is often necessary for the user to walk a distance to a switch box to reestablish electrical contact. The present polishing and scrubbing pad has approximately 35° less material than conventional pads thus reducing drag and clogging. Moreover, the use of multiple cutting edges assures effective removal of hardened wax. The production cost of applicant's polishing and scrubbing pad is greatly reduced since little or no waste is experienced in cutting the pads from large sections of materials.

These and other objects of this invention will become apparent to those skilled in the art to which the invention pertains for a reading of the specification when taken in view of the annexed drawings.

BRIEF DESCRIPTION OF THE DRAWINGS

FIG. 1 is a perspective view, partially cutaway, showing an electrical floor polishing machine with the polishing apparatus of this invention secured thereto.

FIG. 2 is a perspective view of the polishing apparatus showing a plurality of segments attached together by a central connector.

FIG. 3 is a plan view showing a modification of the polishing apparatus of FIG. 2.

DESCRIPTION OF THE PREFERRED EMBODIMENT

Referring now in more detail to the drawings, FIG. 1 depicts a floor polishing machine 10 having a polishing pad supporting frame 12, a motor 14, handle 16 and electric cord 18 for connecting the machine to a source of electric power. The polishing and scrubbing pad 22 is comprised of segments 24, 26, 28 and 30. As the segments 24, 26, 28 and 30 are equally dimensioned, only one will be described in detail hereafter. Each segment has a topside 31 and a bottom side 32 circumscribed by an outside rounded wall 34 and an inside rounded wall 36 and opposing side walls 38 and 40. Each segment has on its inside wall 36 a pair of apertures 42 (one shown) extending parallel to each other a distance into each of the segments. As will be evident, each segment is supported in spaced apart relationship as shown by a connector 50 comprising a plate 52 having an aperture 54. Extending from the plate 52 are a plurality of rods 60 having barbed outer edges 62 and inner rounded ends 64 which are secured to the plate 52 by any suitable means such as welding or the like. The rods 60 form parallel groups having angles of 90° between the groups. The barbed ends 62 are embedded in apertures 42 and are held in place by the barbs 62 and an adhesive (not shown) which may be applied to the barbed ends or may be forced into the apertures by any suitable means such as a tube having a dispensing nozzle. It will be seen that the segments when supported on the connector 50 as shown have spaces 70 between opposing and parallel walls 38 and 40. The area between inside walls 36 defines a circular opening having equal radii extending from the center of the opening 54 to the center C of the inside walls 36. The bottom leading edges 72 of walls 40 function as cutting edges to cut old wax from a floor being worked on. It will then be appreciated that the four segments present four cutting edges 72 to effect efficient removal of wax from a floor being worked on.

The polishing and scrubbing pad 22 on the connector 50 may be reversed when the under surfaces 32 become coated with old wax. In that event, the pad 22 is removed from the rotatable shaft and reversed whereby the upper surfaces 31 are downward to the floor. In this position, the leading edges 80 will function as cutting edges as did the leading edges 72 as described above.

FIG. 3 shows a modified form of the invention wherein segments 124, 126, 128 and 130 are six sided and have equal length side walls 132 and 134 which present plural divergent cutting edges similar to the cutting edges 72, 80 as described above. This device is also reversible whereby surfaces 136 are downward to the floor to be worked on. The spaces 138 between the inner walls 140 of each segment define an open area of square configuration. On the other hand, the spaces 142 between side walls 132 and 133 define open triangular areas.

The polishing and scrubbing pad of the invention is attached to the machine 12 in a conventional way such as by Velco-type fasteners or the like.

The polishing pad thus described is superior in its cutting and polishing abilities because it is segmental, each segment having been cut from a larger piece of material. Cut in this fashion, there is no waste as has been experienced in forming conventional circular polishing pads. Moreover, the polishing pads of this construction are also superior to conventional pads which have a tendency to increase drag on the machine which results in overloading, overheating and the blowing of fuses. Overheating of the machine with conventional pads causes a loss of efficiency and man-hours.

While the invention has been shown and described in detail with reference to a preferred embodiment thereof, it will be appreciated and understood by those skilled in the art to which the invention pertains that various changes in form and detail may be made therein without departing from the spirit and scope of the invention

What I claim is:

1. In combination with a floor polishing machine having a motor, a handle and a polishing pad support, the improvement comprising:

a polishing and scrubbing pad of fibrous material comprised of separate spaced-apart segments each having an outer wall, an inner wall, side walls and top and bottom surfaces;

a connector surrounded by said segments; and said connector having means thereon for gripping the inner wall of each segment whereby the segments are held together in spaced apart relationship to fit a polishing machine.

2. In combination with a floor polishing machine having a motor, a handle and a polishing pad support, the improvement comprising:

a polishing and scrubbing pad of fibrous material having a plurality of spaced apart segments: and connector means having outwardly extending rods with barbs on the ends thereof for engaging each of said segments.

3. In combination with a floor polishing machine having a motor, a handle and a polishing pad support, the improvement comprising:

a polishing and scrubbing pad of fibrous material comprising a plurality of separate equally dimensioned segments;

each segment having a lower surface and a top surface and a leading cutting edge;

connector means positioned centrally between said segments;

support rods extending away from said connector means and parallel to each other;

means on said rods for engaging segment whereby each segment is held in spaced apart relationship; and spaces between said segments defining open areas.

4. A polishing and scrubbing pad for a polishing machine comprising:

a plurality of segments each having outer and inner walls joining side walls and having top and bottom surfaces;

connector means for connecting the pad to a polishing machine and being surrounded by said segments;

support means for each of said segments and extending outwardly from said connector means; and means on said inner walls for engaging said support means whereby said segments are held on said support means in spaced apart relationship.

5. A polishing and scrubbing pad for a polishing machine as defined in claim 4, wherein:

each of said segments has leading edges defining cutting edges to cut wax on a floor.

6. A polishing and scrubbing pad for a polishing machine that is defined in claim 4, wherein:

said connector and said support means comprise a separate unit, differing in material from said polishing pad segments.

7. A polishing and scrubbing pad for a polishing machine as described in claim 4, and:

said support means having barbs thereon to grip said segments.

8. A polishing and scrubbing pad as defined in claim 4 wherein said engaging means comprise apertures for receiving said support means.

9. A polishing and scrubbing pad as defined in claim 8 further comprising an adhesive in said apertures for securing said support means in said apertures.

* * * * *